US007108564B2

(12) United States Patent
Liao

(10) Patent No.: US 7,108,564 B2
(45) Date of Patent: Sep. 19, 2006

(54) CONVERTIBLE PLUG

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/268,462

(22) Filed: Nov. 8, 2005

(65) Prior Publication Data

US 2006/0084324 A1 Apr. 20, 2006

Related U.S. Application Data

(63) Continuation-in-part of application No. 10/967,243, filed on Oct. 19, 2004.

(51) Int. Cl.
*H01R 24/00* (2006.01)

(52) U.S. Cl. ..... 439/676; 439/562; 439/941

(58) Field of Classification Search ..... 439/676, 439/562–563, 941

See application file for complete search history.

(56) References Cited

U.S. PATENT DOCUMENTS

| | | | | |
|---|---|---|---|---|
| 5,660,564 | A * | 8/1997 | Yamanashi et al. | 439/557 |
| 6,093,043 | A * | 7/2000 | Gray et al. | 439/352 |
| 2002/0025703 | A1 * | 2/2002 | Chen | 439/141 |
| 2005/0186854 | A1 * | 8/2005 | Huang | 439/677 |

* cited by examiner

*Primary Examiner*—Truc Nguyen
(74) *Attorney, Agent, or Firm*—Rosenberg, Klein & Lee

(57) ABSTRACT

A convertible plug includes an insulating housing having a plurality of slots, a plurality of contacts arranged in the slots respectively, a convertible member sleeved on the insulating housing in an adjustable manner, and at least one resilient member is arranged between the insulating housing and the convertible member attaches the convertible member to the insulating housing in a resilient manner. Whereby, more than one size specification of the convertible plug is available easily and inexpensively.

7 Claims, 6 Drawing Sheets

CONVERTIBLE PLUG

CROSS-REFERENCE TO OTHER APPLICATIONS

This application is a continuation-in-part of application Ser. No. 10/967,243, filed Oct. 19, 2004, now pending.

BACKGROUND OF THE INVENTION

1. Field of the Invention

The present invention is related to a convertible plug for electrically connecting between several cords, and more particularly to a convertible plug that can be converted to meet different specifications.

2. Description of Related Art

With respect to FIGS. 1A and 1B, a conventional plug is illustrated for electrically connecting with computers and telephones via several cords. The conventional plug includes an insulating housing 10*a*, an orientation member 11*a* disposed at an exterior side of the insulating housing 10*a*, and a plurality of contacts 12*a* arranged inside the insulating housing 10*a*. The contacts 12*a* can move longitudinally over a short distance. When several cords 20*a* need to connect to the conventional plug, the cords 20*a* can be arranged inside the insulating housing 10*a* to touch the contacts 12*a* by penetrating through a rear portion of the insulating housing 10*a*. Thus, the contacts 10*a* can pierce the cords 20*a* to form an electrical connection.

However, the insulating housing 10*a* cannot be possessed of a further width "b" beyond an original width "a" at the same time for being joined with another specified conventional plug. Due to the fixed size of the insulating housing 10*a*, the conventional plug doesn't meet the specifications for more than one sized plug, such as 6P1N or 8P1N. A multiple-size plug is required, however, molding a newly mold increases costs.

SUMMARY OF THE INVENTION

A convertible plug of the present invention is provided so that the convertible plug can alternate between two different kinds of plugs, thereby offering the flexibility missing from the above-mentioned related art. Furthermore, the manufacture costs are reduced and alternating between the two different kinds of plugs thereof will be easy.

The present invention provides a convertible plug. The convertible plug includes an insulating housing having a plurality of slots, a plurality of contacts arranged in the slots respectively, a convertible member sleeved on the insulating housing in an adjustable manner, and at least one resilient member attaching the convertible member to the insulating housing in a resilient manner.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1A:
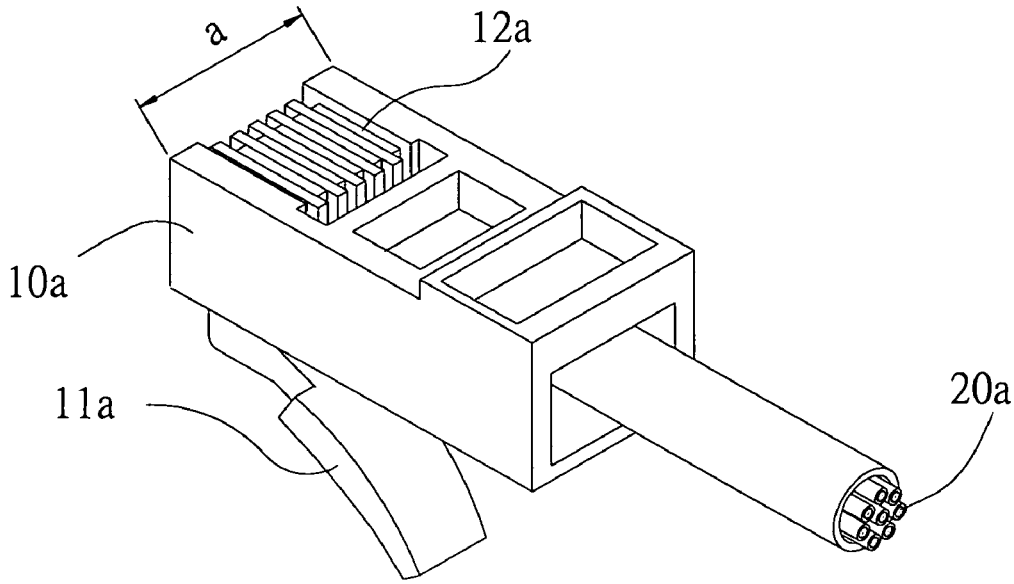
FIG. 1A PRIOR ART
FIG. 1A is a perspective view of a conventional plug.
Figure 1B:
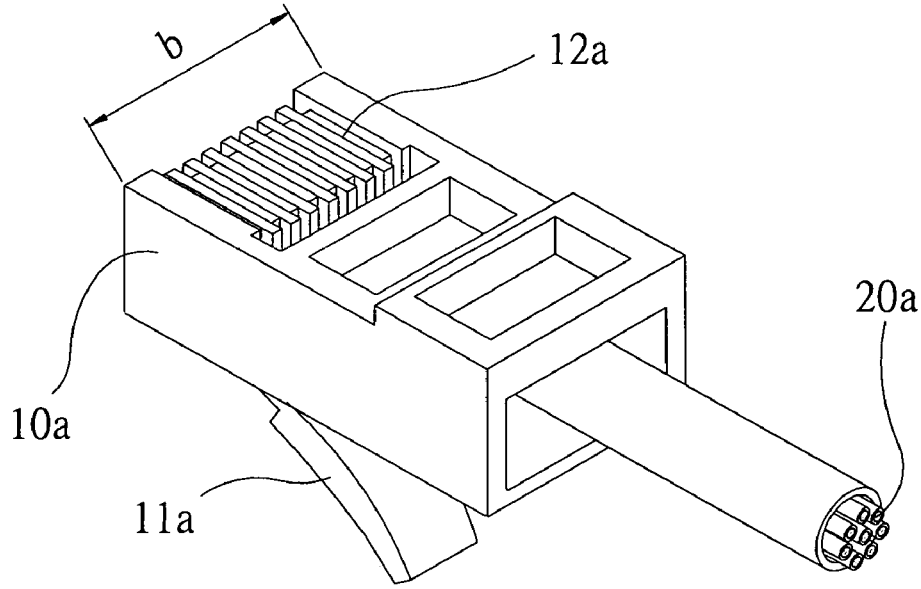
FIG. 1B PRIOR ART
FIG. 1B is a perspective view of a conventional plug meeting another specification.
Figure 2:
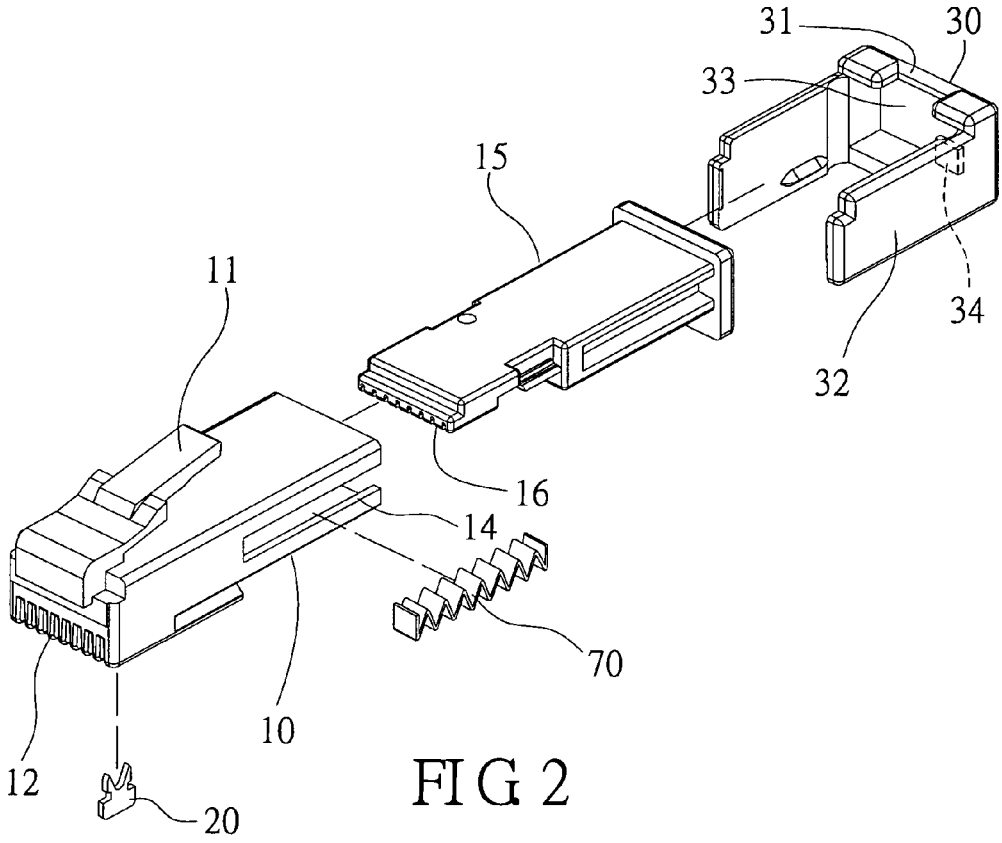
FIG. 2 is a decomposition view according to a first embodiment of a convertible plug of the present invention.
Figure 3:
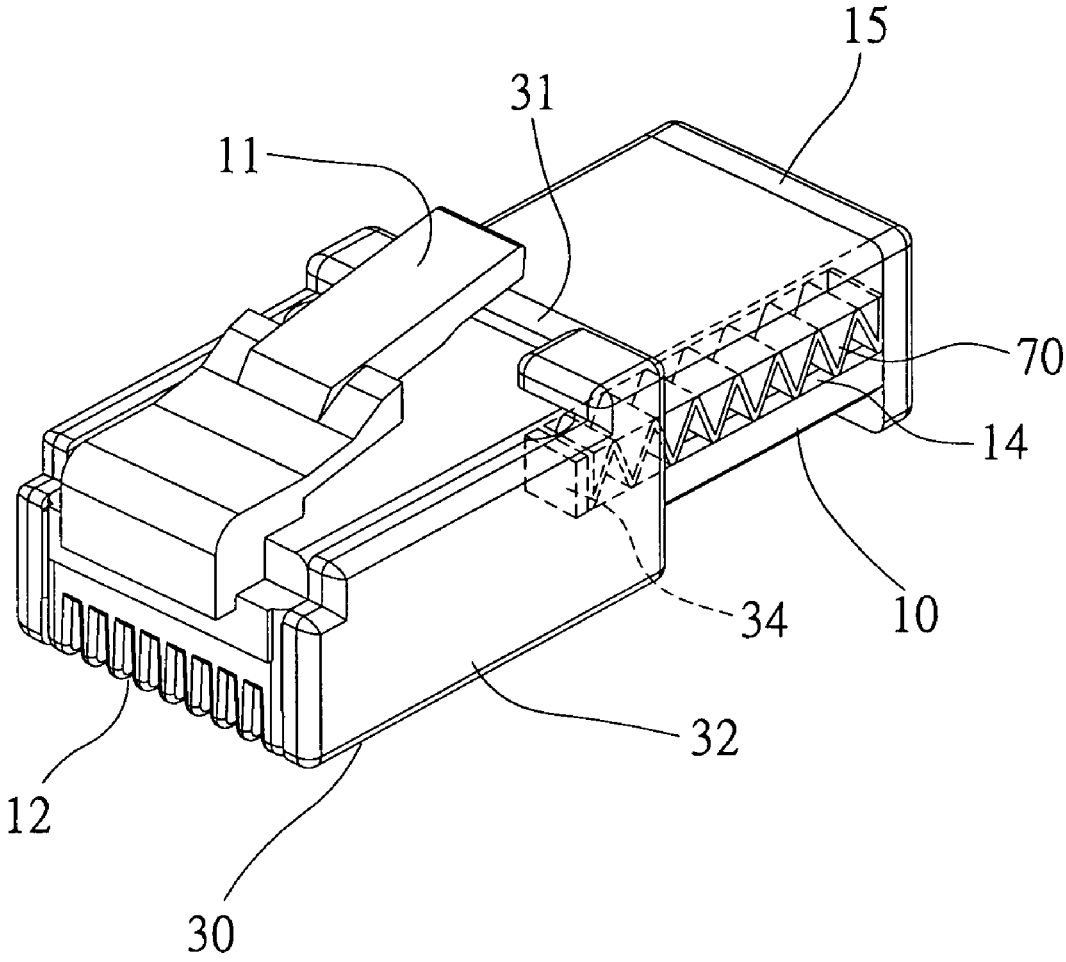
FIG. 3 is a perspective view according to the first embodiment of the convertible plug of the present invention.

Referring to FIGS. 2 to 5, a convertible plug according to the present invention is provided. The convertible plug includes an insulating housing 10, a plurality of contacts 20, a convertible member 30 and at least one resilient member 70. The insulating housing 10 is made of isolation materials, such as plastic. The insulating housing 10 has a hollow cavity and an orientation member 11 disposed at an exterior side thereof. The insulating housing 10 further has a plurality of slots 12 formed in a front thereof, and each of the slots 12 are distanced at fixed intervals. The slots 12 can communicate with the hollow cavity. The number of slots 12 is not limited. In addition, the insulating housing 10 includes a reception channel 14 arranged on at least one side thereof in order to receiving the resilient member 70.

The contacts 20 are made of conductive materials, such as copper, and are arranged in the slots 12 respectively. Each of the contacts 20 has a sharp end, which is used to electronically connect with a respective cord 40. The number of sharp ends is not limited.

Figure 4:
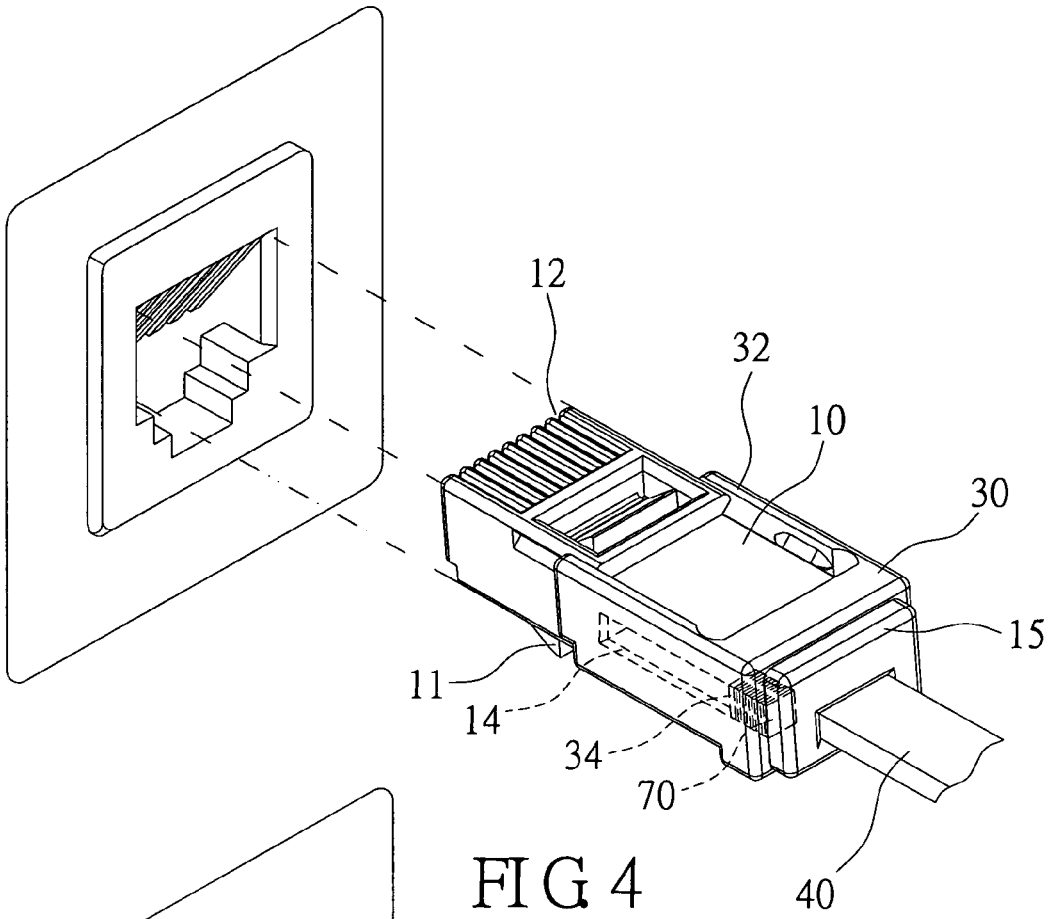
FIG. 4 is a perspective view according to the first embodiment of the convertible plug of the present invention when in use.
Figure 5:
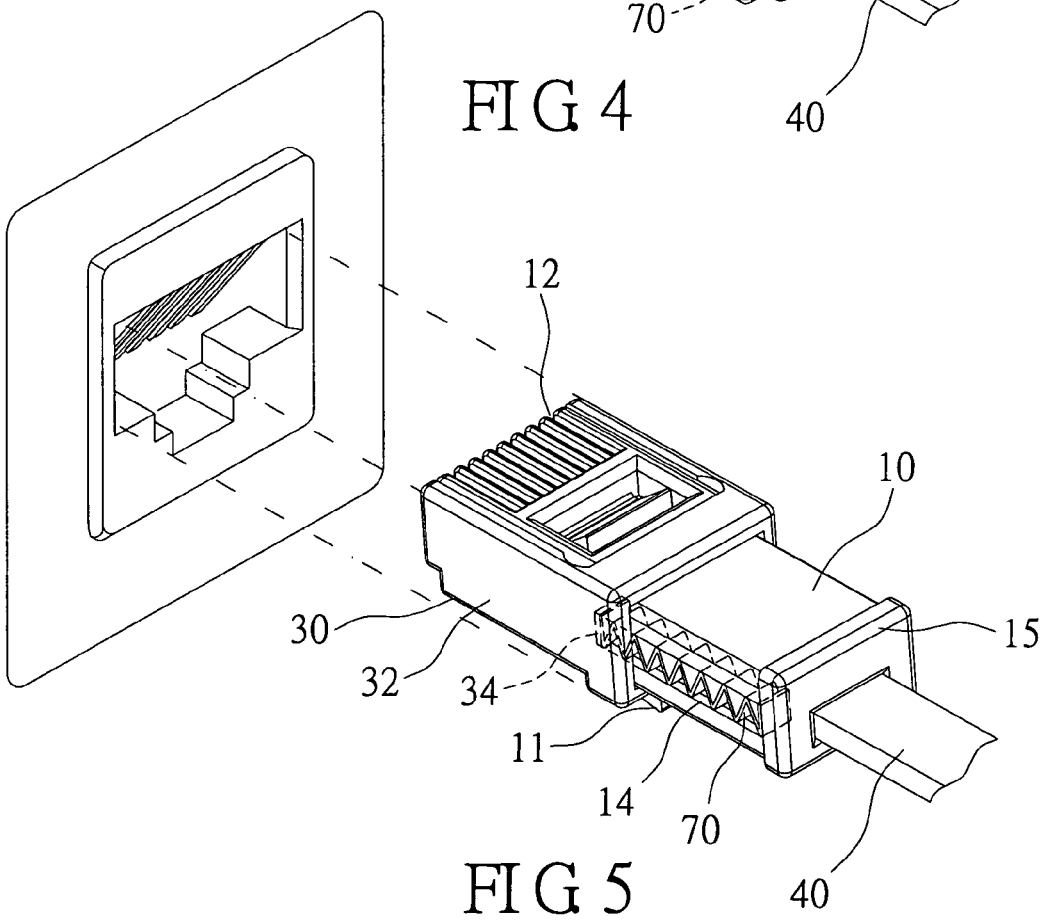
FIG. 5 is a perspective view according to the first embodiment of the convertible plug of the present invention when in another use.

According to the first embodiment, the convertible plug further has a jointing member 15 arranged inside the insulating housing 10. The jointing member 15 is made of isolative materials, such as plastic. Referring to FIGS. 4 and 5, the jointing member 15 can receive the cords 40 penetrated therethrough. The jointing member 15 has a plurality of slits 16 formed at a front portion thereof. The cords 40 can be put into the slits 16 one to one from a rear portion of the jointing member 15. Thus, the cords 40 can be attached to the jointing member 15 in advance. Then, the jointing member 15 can be plugged inside the insulating housing 10 via the rear portion of the insulating housing 10, in order to carry the cords 40 connecting to a front portion of the insulating housing 10. After the jointing member 15 engage in the insulating housing 10, the jointing member 15 and the insulating housing 10 can be treated as a whole. Furthermore, the contacts 20 are pressed into the slots 12 in order to pierce the cords 40 for an electrical connection.

The convertible member 30 is made of isolative materials, such as plastic. The convertible member 30 includes a base 31 and two lateral arms 32 connected to the base 31. The base 31 is substantially rectangular, and the width thereof is larger than that of the insulating housing 10. The base 31 has a sleeve hole 33 formed thereof relative to the insulating housing 10. Moreover, the base 31 and the two lateral arms 32 are formed integrally in one piece. The convertible member 30 can be adjustably sleeved on the insulating housing 10 via the sleeve hole 33, so as to move between first and second predetermined positions of the convertible member 30.

The resilient member 70 is made of flexible materials, such as springs. In this embodiment, there is only one resilient member 70. But the number of resilient members 70 of the present invention is not limited. The resilient member 70, the insulating housing 10 and the convertible member 30 are individual pieces. The resilient member 70 is received inside the reception channel 14 and abuts against the rear portion of the jointing member 15 attached to the insulating housing 10 and a projection 34 arranged on an inner wall of the convertible member 30 via two ends respectively. Therefore, the convertible member 30 can be sleeved on the insulating housing 10 so that the resilient member 70 can be adjusted and arranged between the insulating housing 10 and the convertible member 30.

Accordingly, the convertible plug according to the present invention can electrically connect the cords 40 when the sharp end pierces the cords 40.

The convertible member 30 is sleeved on the insulating housing 10 and can be adjusted. When the convertible plug inserts into a small socket, a peripheral portion of the small socket will abut against the convertible member 30 and push backwards until the convertible member 30 stands at the first position of the insulating housing 10. Thus, a size of a front half of the convertible plug will shrink so that it may be inserted into the small socket, as shown in FIG. 4. If the convertible plug inserts into a large socket, the convertible member 30 will be received in the large socket completely. The resilient member 70 will push the convertible member 30 until the convertible member 30 stands at the second position of the insulating housing 10, so as to increase a front half size of the convertible plug for mechanically connecting to the large socket, as shown in FIG. 5.

Therefore, more than one size specification of the socket is available, so that a remolding process can be omitted and costs can be reduced. Furthermore, the convertible member 30 is flexible and adjustable due to the resilient member 70. Furthermore, it is easy to use.

Figure 6:
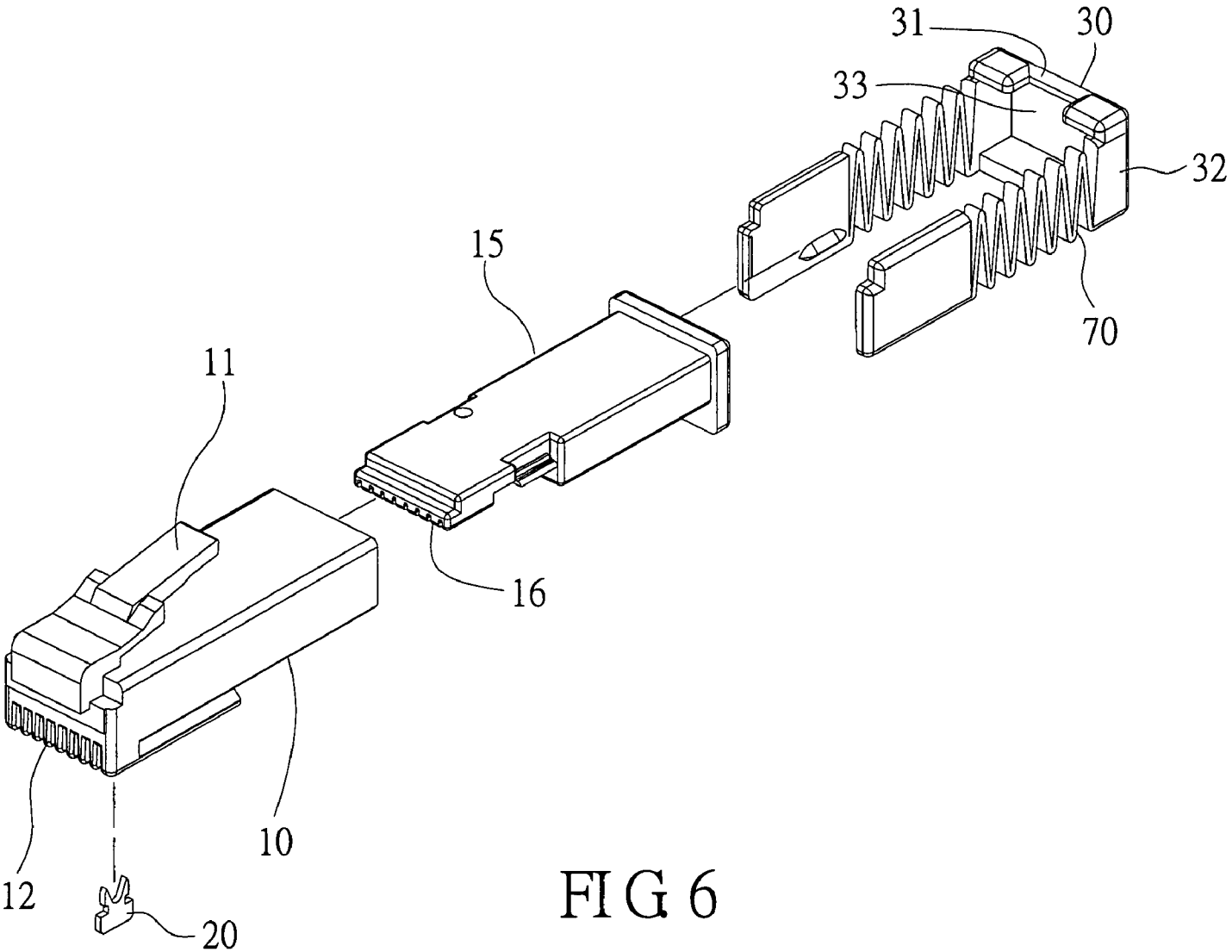
FIG. 6 is a decomposition view according to a second embodiment of the convertible plug of the present invention.
Figure 7:
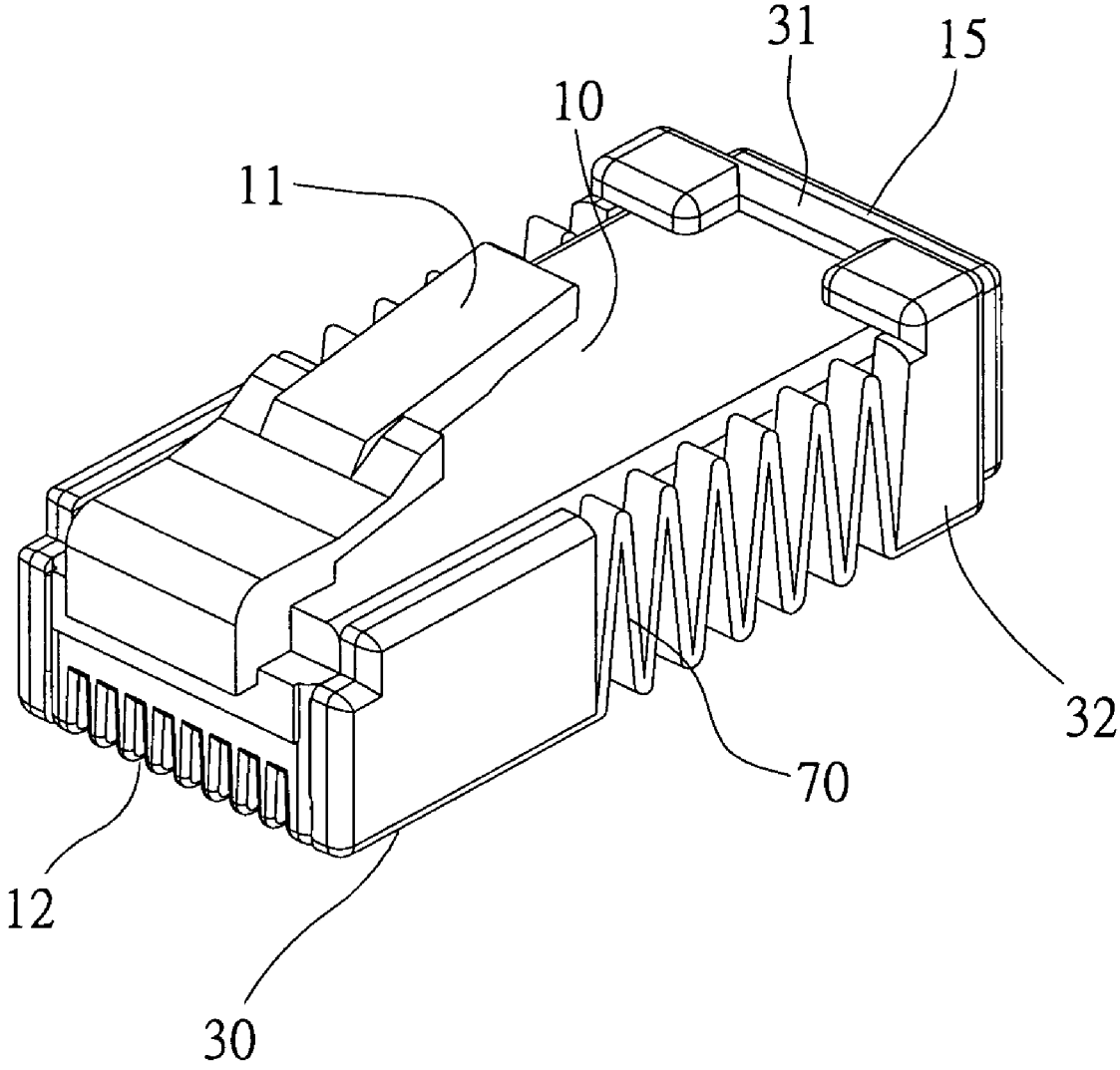
FIG. 7 is a perspective view according to the second embodiment of the convertible plug of the present invention.

With respect to FIGS. 6 and 7, the resilient member 70 and the convertible member 30 are made integrally in one piece. That means the resilient member 70 is an extension from at least one arm 32 of the convertible member 30.

In addition, a USB connector (not shown) can be provided for the rear portion of the insulating housing 10 to electrically connect with the contacts 20 inside the insulating housing 10. The USB connector can be treated as an adapter. The USB connector can be female or male. Also, another connector, plug or receptacle can replace the USB. Furthermore, an IEEE 1394 connector can connect with the rear portion of the insulating housing 10 for electrically connecting the contacts 20, the IEEE 1394 connector also can be an adapter.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A convertible plug comprising:

an insulating housing having a plurality of slots formed at a front portion thereof;

at least one reception channel arranged in at least one side of said insulating housing;

a plurality of contacts disposed in said plurality of slots;

a convertible member having a substantially rectangular base and two lateral arms, said base having a hole defined therein for receiving said insulating housing, said base having a width larger than a width of said insulating housing, said convertible member being sleeved on said insulating housing and displaceable between a first position and a second position; and at least one resilient member being received in said at least one reception channel and arranged between said insulating housing and said convertible member, whereby when said convertible plug is inserted into a small socket, said small socket displaces said convertible member to said first position thereby allowing said convertible plug to be inserted into said small socket.

2. The convertible plug as claimed in claim 1, further comprising a projection formed on said convertible member, said resilient member being in abutting contact with said projection.

3. The convertible plug as claimed in claim 2, wherein the two lateral arms are adjacent to side portions of the insulating housing.

4. The convertible plug as claimed in claim 1, further comprising a cord penetrating a rear portion of the insulating housing and electrically connecting with the contacts.

5. The convertible plug as claimed in claim 1, further comprising a jointing member for a plurality of cords penetrating therethrough, the jointing member having a plurality of slits formed at a front portion thereof, the cords being arranged into the slits from a rear portion of the jointing member so as to be attached to the jointing member, said jointing member being plugged inside the insulating housing.

6. The convertible plug as claimed in claim 1, wherein the resilient member, the insulating housing and the convertible member are individual pieces.

7. The convertible plug as claimed in claim 1, wherein the resilient member and the convertible member are made integrally in one piece.

* * * * *